US010454203B2

(12) United States Patent
Phillips et al.

(10) Patent No.: US 10,454,203 B2
(45) Date of Patent: Oct. 22, 2019

(54) RECEPTACLE CONNECTOR OF AN ELECTRICAL CONNECTOR SYSTEM

(71) Applicant: TE CONNECTIVITY CORPORATION, Berwyn, PA (US)

(72) Inventors: Michael John Phillips, Camp Hill, PA (US); Randall Robert Henry, Lebanon, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/912,689

(22) Filed: Mar. 6, 2018

(65) Prior Publication Data

US 2019/0280420 A1 Sep. 12, 2019

(51) Int. Cl.
*H01R 13/514* (2006.01)
*H01R 13/6594* (2011.01)
*H01R 13/6593* (2011.01)

(52) U.S. Cl.
CPC ..... *H01R 13/514* (2013.01); *H01R 13/6593* (2013.01); *H01R 13/6594* (2013.01)

(58) Field of Classification Search
CPC ..... H01R 12/87; H01R 12/85; H01R 12/89; H01R 13/514
USPC ..... 439/635, 265, 141, 607.636, 607.34
See application file for complete search history.

(56) References Cited

U.S. PATENT DOCUMENTS 4,468,073 A * 8/1984 Machcinski ..... H01R 12/88 439/266
4,747,790 A 5/1988 Masuda et al.
4,894,022 A * 1/1990 Guckenheimer ..... H01R 12/87 439/260
5,167,531 A 12/1992 Broschard, III et al.
5,501,613 A 3/1996 Lenoir
5,863,222 A 1/1999 Kinsey, Jr. et al.
6,080,011 A 6/2000 Tsao et al.
6,083,023 A * 7/2000 Kamath ..... H01R 13/62922 439/263
6,099,349 A 8/2000 Boutros
6,350,152 B1 2/2002 Belopolsky et al.
6,565,387 B2 5/2003 Cohen
6,821,144 B2 11/2004 Choy
7,338,303 B1 * 3/2008 Yi ..... H01R 12/87 439/267

(Continued)

FOREIGN PATENT DOCUMENTS

WO WO 2016018709 A1 * 2/2016 ..... H01R 12/721

*Primary Examiner* — Tulsidas C Patel
*Assistant Examiner* — Marcus E Harcum

(57) ABSTRACT

An electrical connector system includes a receptacle connector having a housing, a contact assembly held in the housing and an insert movably received in the housing and supporting the contact assembly. The housing has a cavity and a mating end including a slot receiving a circuit card. The contact assembly is received in the cavity and includes contacts. Each contact has a base fixed in the cavity and a mating end movable relative to the base between an undeflected position and a deflected position. The insert is received in the cavity and is movable in the cavity between a forward position and a retracted position. The insert holds the mating ends of the contacts in the undeflected positions when in the forward position. The insert engages the contacts and forces the contacts to the deflected positions when in the retracted position.

20 Claims, 6 Drawing Sheets

(56) References Cited

U.S. PATENT DOCUMENTS 7,390,208 B1 * 6/2008 Sabo ..... H01R 12/57 439/260
7,866,993 B2 * 1/2011 Ohsumi ..... H01R 12/721 439/141
8,162,675 B2 4/2012 Regnier et al.
8,187,019 B2 5/2012 Reed et al.
8,226,441 B2 7/2012 Regnier et al.
8,241,045 B2 8/2012 Reed et al.
8,342,881 B2 1/2013 Lang et al.
8,414,324 B2 4/2013 Reed et al.
8,439,704 B2 5/2013 Reed
8,449,312 B2 5/2013 Lang et al.
8,460,033 B2 6/2013 Regnier et al.
8,465,302 B2 6/2013 Regnier et al.
8,480,413 B2 7/2013 Minich et al.
8,573,997 B2 11/2013 Neer et al.
8,597,055 B2 12/2013 Regnier et al.
8,641,438 B2 * 2/2014 Kamiya ..... H01R 12/721 439/260
8,678,839 B2 3/2014 Reed et al.
8,740,646 B2 6/2014 Lang et al.
8,753,145 B2 6/2014 Lang et al.
8,821,168 B2 9/2014 Reed et al.
8,926,377 B2 1/2015 Kirk et al.
9,028,281 B2 5/2015 Kirk et al.
9,065,230 B2 6/2015 Milbrand, Jr.
9,461,392 B2 10/2016 Regnier et al.
9,748,713 B2 8/2017 Regnier et al.
2003/0119366 A1 * 6/2003 Wu ..... H01R 12/7029 439/636
2006/0166551 A1 7/2006 Korsunsky et al.
2006/0270254 A1 * 11/2006 Chiang ..... H01R 13/4538 439/137
2013/0017710 A1 1/2013 Houtz
2014/0187086 A1 * 7/2014 Little ..... H01R 13/6585 439/607.34
2014/0235107 A1 * 8/2014 Liang ..... H01R 12/87 439/637
2015/0236437 A1 * 8/2015 Briant ..... H01R 12/737 439/636
2017/0170606 A1 * 6/2017 Phillips ..... H01R 13/6585

* cited by examiner

RECEPTACLE CONNECTOR OF AN ELECTRICAL CONNECTOR SYSTEM

BACKGROUND OF THE INVENTION

The subject matter herein relates generally to receptacle connectors of electrical connector systems.

At least some known electrical connector systems include receptacle connectors, such as input/output (I/O) connectors, that are configured to receive a pluggable module, such as a transceiver module, paddle card, and the like, to establish a communicative connection between the pluggable module and the receptacle connector. As one example, a known electrical connector system includes a cage member surrounding a receptacle connector that is mounted to a circuit board and configured to receive a pluggable transceiver in an elongated cavity of the cage member. The pluggable transceiver including a circuit card and the receptacle connector have respective contacts that engage one another to establish a communicative connection.

Conventional receptacle connectors have housings with contact channels holding the contacts in a slot, such as in an upper row and a lower row. The housings are manufactured from dielectric material that affects the impendence of the receptacle connector, such as in the mating zone. For example, the dielectric material between the contacts lowers the impedance in the mating zone. The contacts typically have varying widths along their lengths, such as being narrower at the tips, leading to variations in the spacing between the contacts along the length. The varied spacing causes the impedance of the contacts to be lower where the contacts have greater spacing and higher where the contacts have narrower spacing. The contacts of the receptacle connector have mating beams including flared ends that are flared outward (away from the mating interface) to reduce the risk of mechanical stubbing and damaging of the contacts during mating with the circuit card. The flared ends extend forward of the mating interfaces, creating an electrical stub at the end of each contact.

BRIEF DESCRIPTION OF THE INVENTION

In one embodiment, an electrical connector system is provided including a receptacle connector having a housing, a contact assembly held in the housing and an insert movably received in the housing and supporting the contact assembly. The housing has a cavity and a mating end including a slot open to the cavity configured to receive a circuit card. The contact assembly is received in the cavity and includes contacts arranged in an upper row and a lower row. Each contact has a base fixed in the cavity and a mating end movable relative to the base between an undeflected position and a deflected position. The insert is received in the cavity and is movable in the cavity between a forward position and a retracted position. The insert holds the mating ends of the contacts in the undeflected positions when in the forward position. The insert engages the contacts and forces the contacts to the deflected positions when in the retracted position.

In another embodiment, an electrical connector system is provided including a receptacle connector having a housing, a contact assembly held in the housing and an insert movably received in the housing and supporting the contact assembly. The housing has a cavity and a mating end including a slot open to the cavity configured to receive a circuit card. The contact assembly is received in the cavity and includes signal contacts and ground contacts arranged in both an upper row and a lower row. Each signal contact has a signal beam extending to a mating end. Each ground contact has a ground beam extending to a mating end. The insert is received in the cavity and is movable in the cavity between a forward position and a retracted position. The insert has a ground bus bar. The insert engages the signal contacts and the ground contacts and forces the signal contacts and the ground contacts into mating engagement with the circuit card when the insert is in the retracted position. The ground bus bar engages the ground beams to electrically connect corresponding ground contacts when in the retracted position.

In a further embodiment, an electrical connector system is provided including a receptacle connector having a housing, a contact assembly held in the housing and an insert movably received in the housing and supporting the contact assembly. The housing has a cavity and a mating end including a slot open to the cavity being configured to receive a circuit card. The contact assembly is received in the cavity. The contact assembly includes signal contacts and ground contacts arranged in both an upper row and a lower row. Each signal contact has a signal beam extending to a mating end. Each ground contact has a ground beam extending to a mating end. The insert is received in the cavity and is movable in the cavity between a forward position and a retracted position. The insert engages the signal beams and forces the mating ends of the signal contacts into mating engagement with the circuit card when the insert is in the retracted position. The insert engages the ground beams and forces the mating ends of the ground contacts into mating engagement with the circuit card when the insert is in the retracted position. The mating ends are positioned closer to each other in the retracted position compared to the forward position for mating the contacts with the circuit card. The mating ends are more exposed to air when the insert is in the retracted position.

DETAILED DESCRIPTION OF THE INVENTION

Figure 1:
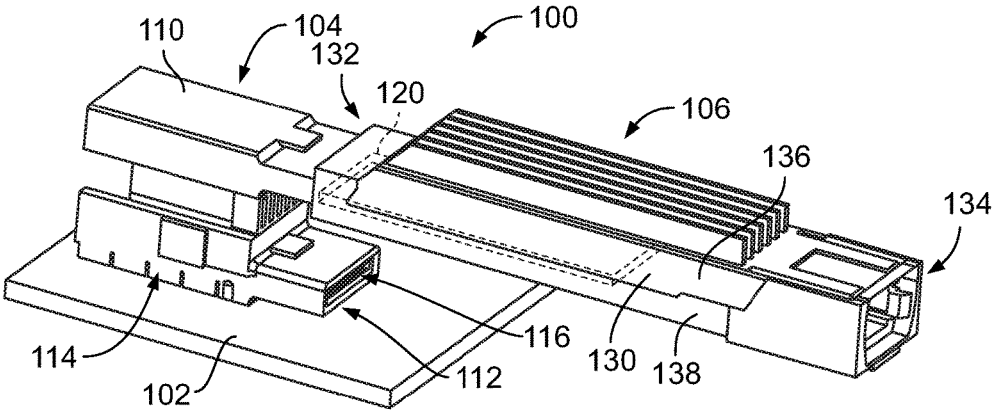
FIG. 1 is a front perspective view of a communication system in accordance with an embodiment.

FIG. 1 is a front perspective view of a communication system 100 in accordance with an embodiment. The communication system 100 includes a circuit board 102, a receptacle connector 104 mounted to the circuit board 102, and a pluggable module 106 that is configured to be coupled to the receptacle connector 104. The circuit board 102 may be a daughter card or a mother board and include conductive traces (not shown) extending therethrough. The pluggable module 106 is communicatively coupled to the circuit board 102 through the receptacle connector 104 to send and/or receive data signals with components of the communication system 100.

The communication system 100 may be part of or used with telecommunication systems or devices. For example, the communication system 100 may be part of or include a switch, router, server, hub, network interface card, or storage system. In the illustrated embodiment, the pluggable module 106 is configured to transmit data signals in the form of electrical signals. In other embodiments, the pluggable module 106 may be configured to transmit data signals in the form of optical signals.

The receptacle connector 104 includes a housing 110 having a mating end 112 and a mounting end 114. The mounting end 114 is configured to be mounted to the circuit board 102. The mating end 112 is configured to be mated with the pluggable module 106. In an exemplary embodiment, the housing 110 includes a slot 116 at the mating end 112 that receives a portion of the pluggable module 106. For example, the slot 116 may be a card slot configured to receive a circuit card of the pluggable module 106. The receptacle connector 104 may have multiple mating interfaces at the mating end 112 when configured to mate with multiple pluggable modules 106, such as when used in a stacked cage member. The receptacle connector 104 includes contacts (not shown) that are configured to be mated with the pluggable module 106 and the circuit board 102. The receptacle connector 104 may be incorporated into a cage assembly, such as a single or multi-port cage assembly that provides electrical shielding around the pluggable module 106 and the receptacle connector 104.

In the illustrated embodiment, the pluggable module 106 is an input/output (I/O) module, such as a transceiver module. For example, the pluggable module 106 may be a small form-factor pluggable (SFP) transceiver or quad small form-factor pluggable (QSFP) transceiver, such as those satisfying certain technical specifications for SFP or QSFP transceivers, such as Small-Form Factor (SFF)-8431. Other types of receptacle connectors 104 and pluggable modules 106 may be used in alternative embodiments, such as a card edge connector and a circuit card.

The pluggable module 106 has a pluggable body 130, which may be defined by one or more shells. For example, in the illustrated embodiment, the pluggable body 130 includes an upper shell 136 and a lower shell 138. The pluggable body 130 may be thermally conductive and/or may be electrically conductive, such as to provide EMI shielding for the pluggable module 106. The pluggable body 130 includes a mating end 132 and an opposite cable end 134. The mating end 132 is configured to be mated with the receptacle connector 104. The cable end 134 may have one or more cables (not shown) extending to another component within the system.

In an exemplary embodiment, the pluggable module 106 includes a circuit card 120 (shown in phantom in FIG. 1) held within the pluggable body 130. The circuit card 120 is configured to be communicatively coupled to the receptacle connector 104. The circuit card 120 may be accessible or exposed at the mating end 132. The cables are terminated to the circuit card 120. The circuit card 120 has communication components (not shown) connected thereto for transmitting the signals between the cables and the mating end of the circuit card 120. For example, the circuit card 120 may have conductors, traces, pads, electronics, optical modules, sensors, controllers, switches, inputs, outputs, and the like associated with the circuit card 120, which may be mounted to the circuit card 120, to form circuits and to control operation of the pluggable module 106.

Figure 2:
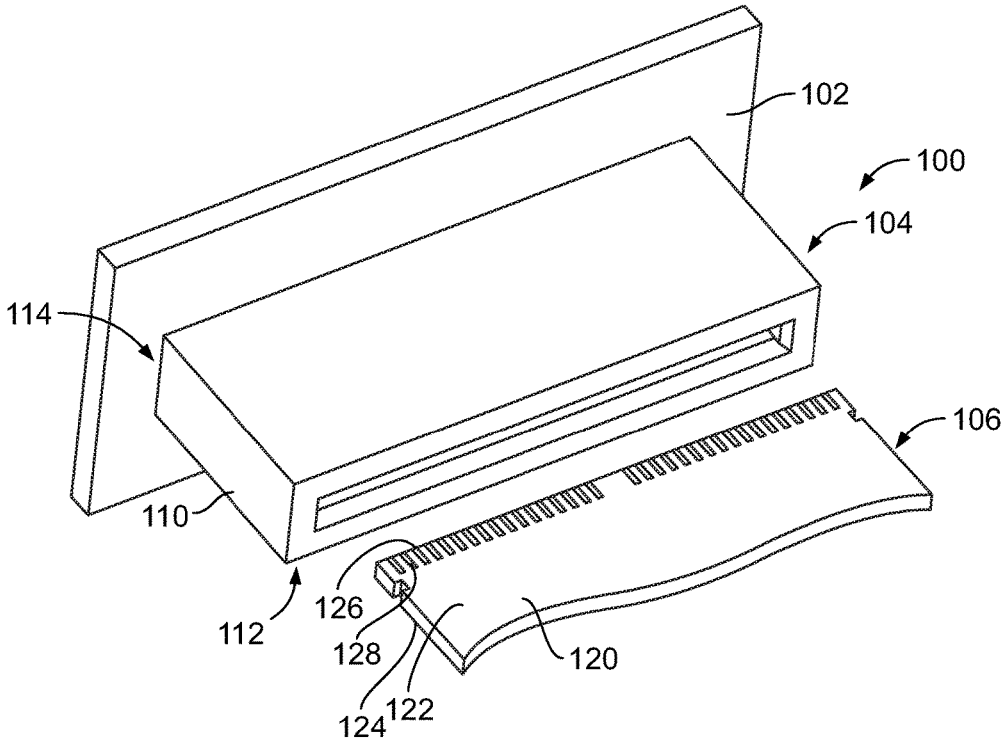
FIG. 2 is a front perspective view of the communication system in accordance with an embodiment.

FIG. 2 is a front perspective view of the communication system 100 in accordance with an embodiment. The receptacle connector 104 is shown as a card edge connector (receptacle) mounted to the circuit board 102. The pluggable module 106 is configured to be coupled to the receptacle connector 104. In the illustrated embodiment, the receptacle connector 104 is a pass-through connector having the mating end 112 and the mounting end 114 of the housing 110 parallel to each other rather than perpendicular to each other such that the contacts pass straight through the housing 110 rather than being right angle contacts.

In the illustrated embodiment, the pluggable module 106 includes the circuit card 120. The circuit card 120 includes an upper surface 122 and a lower surface 124. The circuit card 120 includes a card edge 126 at a mating end of the circuit card 120. The circuit card 120 includes contact pads 128 at the card edge 126 configured to be mated with the contacts of the receptacle connector 104.

Figure 3:
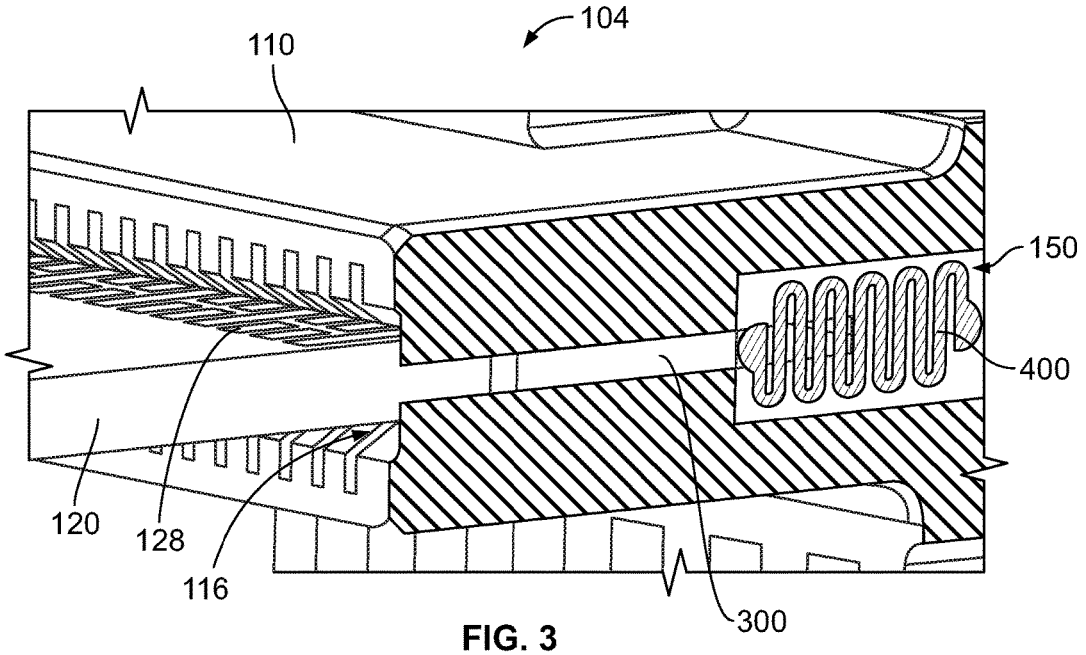
FIG. 3 is a partial sectional view of the communication system in accordance with an exemplary embodiment showing a pluggable module partially mated with a receptacle connector.
Figure 4:
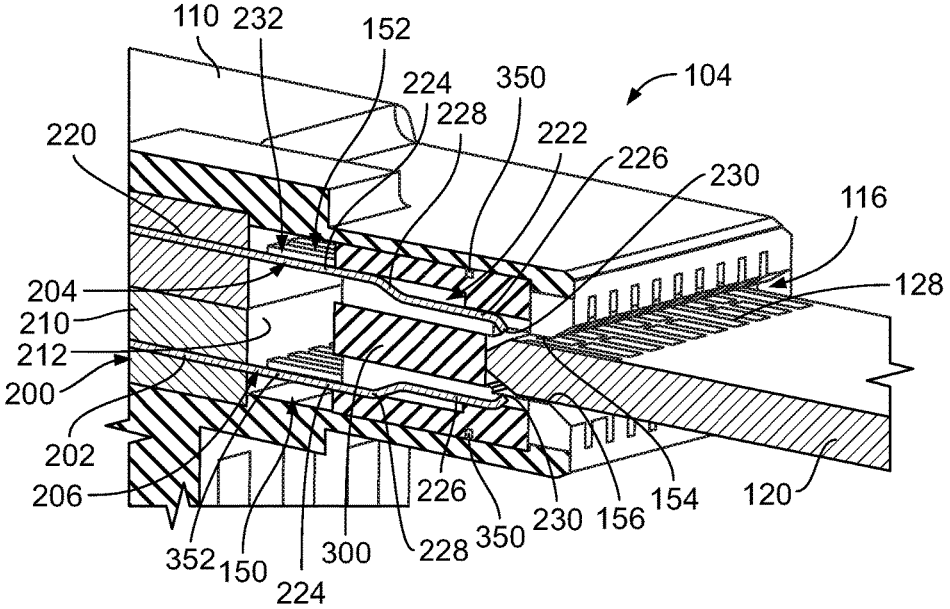
FIG. 4 is a partial sectional view of the receptacle connector in accordance with an exemplary embodiment.

FIG. 3 is a partial sectional view of the communication system in accordance with an exemplary embodiment showing the pluggable module partially mated with receptacle connector 104. FIG. 4 is a partial sectional view of the receptacle connector 104 in accordance with an exemplary embodiment. The receptacle connector 104 includes the housing 110, a contact assembly 200 held in the housing 110 and an insert 300 movably received in the housing 110 and supporting the contact assembly 200. In the illustrated embodiment, the receptacle connector 104 includes a return spring 400 (FIG. 3) operably coupled to the insert 300 for pressing the insert 300 forward.

Figure 10:
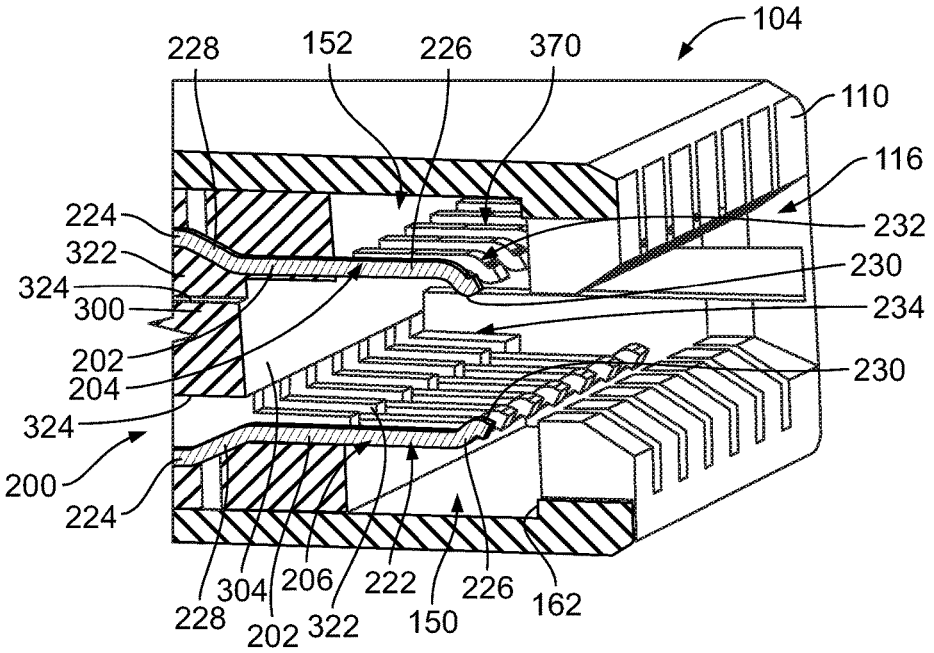
FIG. 10 is a partial sectional view of a portion of the receptacle connector showing the insert in a retracted position.

In an exemplary embodiment, the housing 110 is manufactured from a dielectric material, such as a plastic material. The housing 110 may be molded, such as injection molded. The housing 110 may be a single piece or may be assembled from multiple pieces. The housing 110 includes a cavity 150 rearward of the slot 116. The slot 116 is open to the cavity 150. The insert 300 and the contact assembly 200 are held in the cavity 150. In an exemplary embodiment, the cavity 150 includes an insert chamber 152 at a front portion of the cavity 150. The insert 300 is movably received in the insert chamber 152. The insert 300 is movable in the insert chamber 152 of the cavity 150 between a forward position (FIG. 4) and a retracted position (FIG. 10).

The contact assembly 200 includes a plurality of contacts 202 arranged in the cavity 150 for mating with the circuit card 120 (shown in FIG. 1). The contacts 202 may include signal contacts, ground contacts and/or other types of contacts such as power contacts. In an exemplary embodiment, the contacts 202 are arranged in an upper row 204 of contacts and a lower row 206 of contacts. The upper row of contacts 204 are arranged along the top of the cavity 150 and the lower row of contacts 206 are arranged along the bottom of the cavity 150. The circuit card 120 is configured to be received between the upper and lower rows of contacts 204, 206. In an exemplary embodiment, the insert 300 surrounds the upper and lower rows of contacts 204, 206.

The contact assembly 200 includes a holder 210 holding the contacts 202. In an exemplary embodiment, the holder 210 is manufactured from a dielectric material to electrically isolate the contacts 202 from each other. In various embodiments, the holder 210 may include a ground bus (not shown) for electrically connecting ground contacts. In an exemplary embodiment, the holder 210 may be overmolded around the array of contacts 202 during manufacture; however, the contacts 202 may be coupled to the holder 210 by other means in alternative embodiments, such as loading or stitching the contacts 202 into the holder 210. Optionally, the holder 210 may include an upper holder and a lower holder holding the upper row of contacts 204 and the lower row of contacts 206, respectively. The holder 210 is held in the cavity 150. In various embodiments, the holder 210 is fixed in the cavity 150, by using latches, fasteners, an interference fit or other securing means. The holder 210 includes a front wall 212 facing the insert chamber 152. The contacts 202 extend forward of the front wall 212.

Each contact 202 includes a base section 220 held by the holder 210. The contact 202 includes a mating end 222 extending forward of the holder 210. The mating end 222 has a mating beam 224 and a tip 226 at a distal end of the mating beam 224. The mating beam 224 is cantilevered from the holder 210. In an exemplary embodiment, the mating end 222 has a ramp 228, located between the mating beam 224 and the tip 226. The ramp 228 may transition the tip 226 inward. For example, the ramps 228 of the upper contacts 202 may transition the tips 226 downward toward the lower contacts and the ramps 228 of the lower contacts 202 may transition the tips 226 upward toward the upper contacts 202. Optionally, the mating beams 224 may be oriented generally horizontally and the tips 226 may be oriented generally horizontally with the ramps 228 being angled therebetween.

In an exemplary embodiment, the mating beams 224 of the contacts 202 are wider than the tips 226 of the contacts 202. The tips 226 may be narrower for electrical connection with the contact pads 128 of the circuit card 120, such as to avoid inadvertent electrical connection with an adjacent contact pad 128. The tips 226 may be narrower to allow deflection of the contacts 202 at the tips 226, such as when mated with the corresponding contact pads 128. For example, higher flexibility may prevent damage to the contact pads 128 when wiping along the contact pads 128 during mating. The mating beams 224 may be wider for structural integrity of the contacts 202. For example, the wider mating beams 224 may provide sufficient holding or spring force of the contacts 202 against the circuit card 120.

The contact 202 includes a mating interface 230 along the tip 226. Optionally, the tip 226 may be curved at the mating interface 230, such as for mating with the circuit card 120. The tip 226 may be curved to prevent mechanical stubbing when mating with the circuit card 120. In an exemplary embodiment, the length of the tip 226 forward of the mating interface 230 is relatively short to reduce any electrical stub in the contact 202. Optionally, the mating interface 230 may be provided at the distal end such that the contact 202 does not extend beyond the mating interface 230. In an exemplary embodiment, the mating interfaces 230 of each of the contacts 202 in the upper row 204 are coplanar and the mating interfaces 230 of each of the contacts 202 in the lower row 206 are coplanar and spaced apart from the upper row 204.

Figure 9:
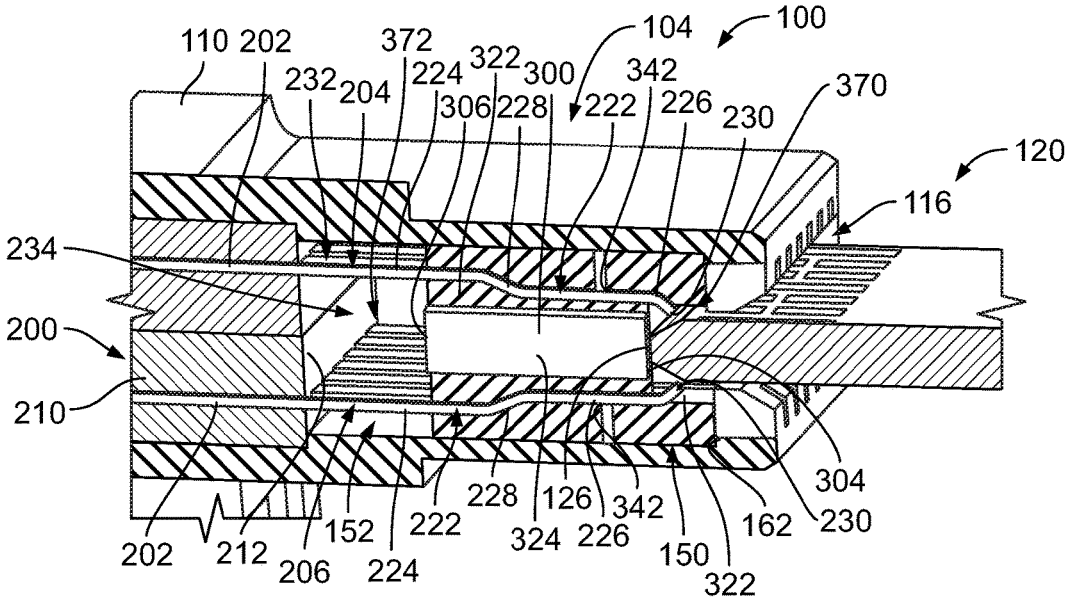
FIG. 9 is a partial sectional view of a portion of the communication system showing the insert in a forward position.

In an exemplary embodiment, adjacent contacts 202 are separated by contact gaps 232 (FIGS. 9 and 10). The spacing of the contact gaps 232 may be controlled by the insert 300. The widths of the contact gaps 232 may be variable along the lengths of the contacts 202. For example, the contact gaps 232 may be narrower along the mating beams 224 and may be wider along the tips 226.

In an exemplary embodiment, when the insert 300 is in the forward position (FIG. 4), the insert 300 supports the mating ends 222 of the contacts 202 in the upper and lower rows 204, 206. For example, the insert 300 may support a side-to-side position of the contact 202 and/or a vertical position of the contact 202. In an exemplary embodiment, the insert 300 supports the contacts 202 in the upper row 204 from above (for example, restricts upward movement thereof) and supports the contacts 202 in the lower row 206 from below (for example, restricts downward movement thereof). The insert 300 may support the mating beam 224 and/or the tip 226. In an exemplary embodiment, in the forward position, the insert 300 has spacing that allows the contact rows 204, 206 to be spread apart to create a wide opening for receiving the circuit card 120 without the risk of mechanical stubbing during loading of the circuit card 120 into the slot 116. For example, tips 226 of the contacts in each row may be spread apart a greater distance than the thickness of the circuit card 120. Optionally, such position may be the natural or resting position of the contacts 202 with the contacts 202 being configured to be pushed inward after the circuit card 120 is loaded into the slot 116. The contacts 202 may naturally rest in the insert 300 in undeflected positions when the insert 300 is in the forward position. However, in various embodiments, the insert 300 may partially deflect the contacts 202 in the forward position, such as using the walls of the insert 300 to partially deflect the contacts 202. Even in the partially deflected position, the tips 226 of the contacts 202 in the upper row 204 are located above an upper wall 154 of the slot 116 and/or the tips 226 of the contacts 202 in the lower row 206 are located below a lower wall 156 of the slot 116.

In an exemplary embodiment, the insert 300 is configured to be pushed rearward to the retracted position (FIG. 10) by the circuit card 120 as the circuit card 120 is loaded into the housing 110. The contacts 202 may be pressed inward by the insert 300 to engage the circuit card 120 when the insert 300 is moved rearward to the retracted position. For example, the insert 300 may include cam surfaces configured to engage the contacts 202 to push the contacts 202 inward to deflected positions to engage the circuit card 120. Because the circuit card 120 is already positioned between the tips 226 of the contacts 202 in the upper and lower rows 204, 206 when the contacts 202 are moved inward, there is no risk of mechanical stubbing of the contacts 202 on the circuit card 120 when the circuit card 120 is loaded into the housing 110. As such, the lengths of the tips 226 of the contacts 202 may be shortened compared to conventional contacts that have long tips to define a large catch window for the circuit card 120, such long tips generally creating electrical stubs on the contacts. By shortening the tips 226, the contacts 202 have a shorter electrical stub compared to conventional contacts, enhancing the electrical performance and signal integrity of the contacts 202.

In an exemplary embodiment, the insert 300 includes ground bus bars 350 therein used to electrically common corresponding ground contacts 352. The ground bus bars may be located along the top and the bottom of the insert 300. The ground bus bars may have grounding portions that are configured to engage the ground contacts 352; however, the ground bus bars 350 are electrically isolated from the signal contacts 202. The ground bus bars 350 engage the ground contacts 352 when the insert is in the retracted position. Optionally, the ground bus bars 350 may engage the ground contacts 352 when the insert 300 is in the forward position.

Figure 5:
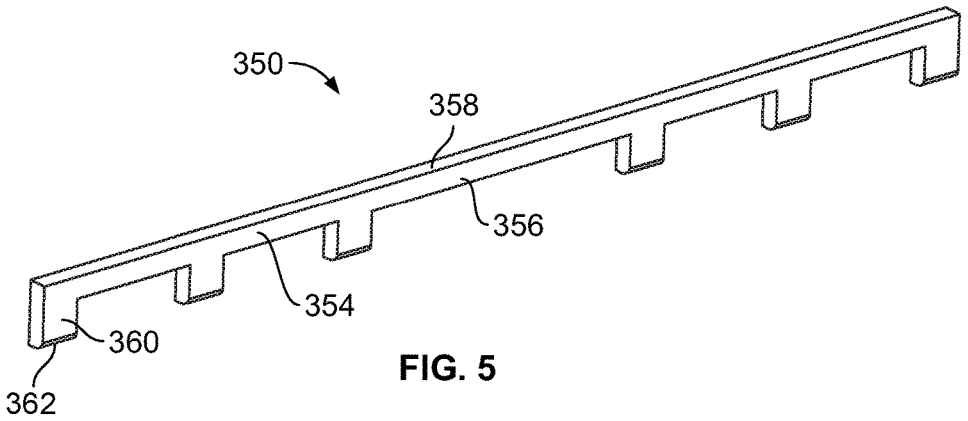
FIG. 5 is a perspective view of a ground bus bar of the receptacle connector in accordance with an exemplary embodiment.

FIG. 5 is a perspective view of the ground bus bar 350 in accordance with an exemplary embodiment. The ground bus bar 350 includes a main body 354 extending between an inner edge 356 and an outer edge 358. The ground bus bar 350 includes a plurality of ground fingers 360 extending from the inner edge 356. The ground fingers 360 are configured to engage corresponding ground contacts 352 (shown in FIG. 4). Optionally, the ground fingers 360 may be deflectable. Alternatively, the ground fingers 360 may be rigid. The ground fingers 360 include mating interfaces 362 configured to engage the ground contacts 352. The mating interfaces 360 may be provided at the distal ends of the ground fingers 360. The mating interfaces 362 may be curved. The mating interfaces 362 may define cam surfaces for the ground contacts 352. Any number of ground fingers 360 may be provided along the main body 354. The ground fingers 360 have a spacing corresponding to the spacing of the ground contacts 352.

Figure 6:
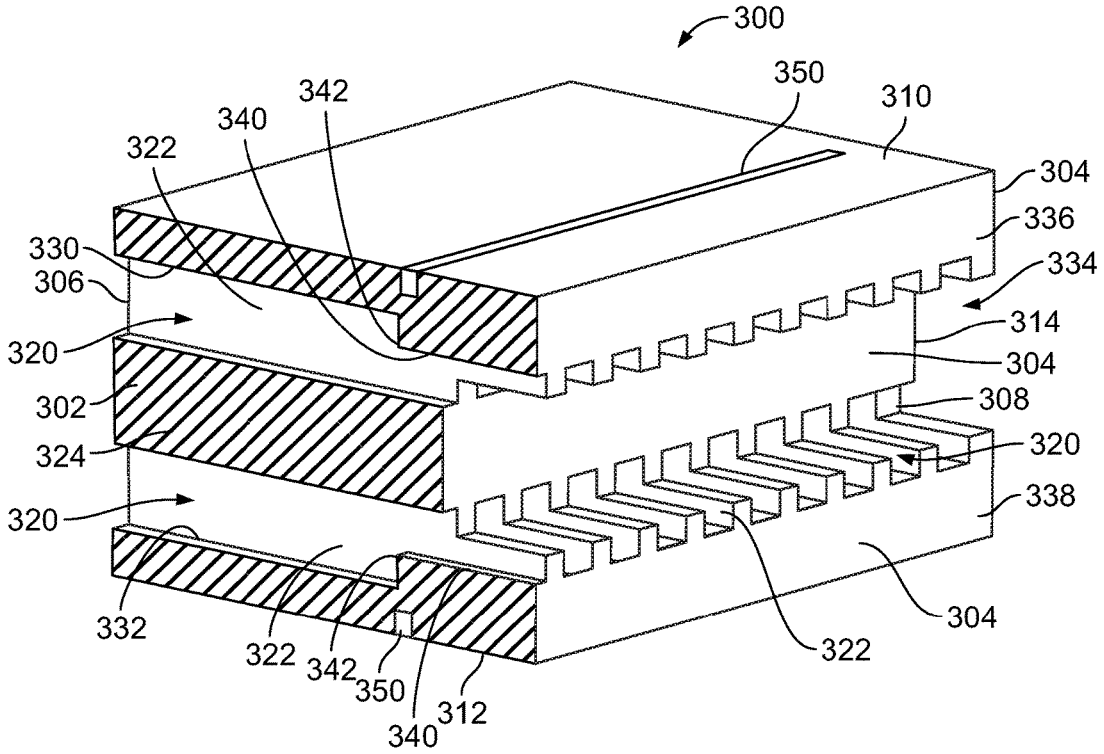
FIG. 6 is a partial sectional view of an insert of the receptacle connector in accordance with an exemplary embodiment.
Figure 7:
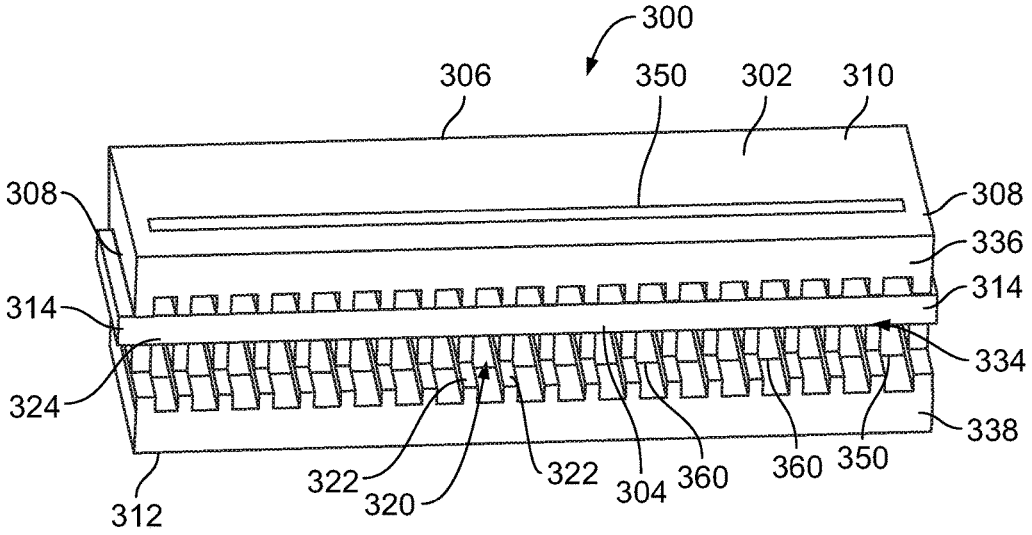
FIG. 7 is a front perspective view of the insert in accordance with an exemplary embodiment.
Figure 8:
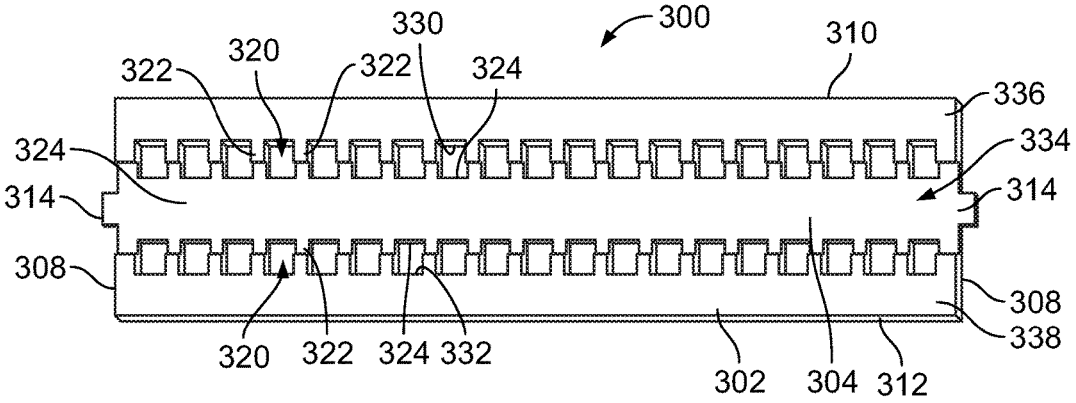
FIG. 8 is a front view of the insert in accordance with an exemplary embodiment.

FIG. 6 is a partial sectional view of the insert 300 in accordance with an exemplary embodiment. FIG. 7 is a front perspective view of the insert 300 in accordance with an exemplary embodiment. FIG. 8 is a front view of the insert 300 in accordance with an exemplary embodiment.

The insert 300 includes a main body 302 extending between a front wall 304 and a rear wall 306. The insert 300 includes end walls 308 at opposite ends of the main body 302. The end walls 308 extend between a top 310 and a bottom 312 of the insert 300. The end walls 308 may abut against end walls of the housing 110 at opposite ends of the cavity 150 (shown in FIG. 4). Optionally, the top 310 may engage a top wall of the housing 110 and the bottom 312 may engage a bottom wall of the housing 110 to orient the insert 300 within the cavity 150. In an exemplary embodiment, the insert 300 includes guide rails 314 configured to be received in corresponding guide slots in the end walls of the housing 110. The guide rails 314 may guide forward and rearward movement of the insert 300 within the cavity 150. The end walls 308 may guide forward and rearward movement of the insert 300 within the cavity 150.

In an exemplary embodiment, the insert 300 includes a plurality of contact channels 320 configured to receive corresponding contacts 202. The contact channels 320 are separated by separating walls 322 and a central base wall 324. The contact channels 320 are arranged in an upper row above the base wall 324 and a lower row below the base wall 324. The separating walls 322 extend from the base wall 324 to define the contact channels 320. The base wall 324 defines portions of the contact channels 320. The separating walls 322 are configured to electrically isolate adjacent contacts 202 in a row from each other. The separating walls 322 are configured to position the contacts 202 relative to each other. For example, the separating walls 322 may hold the contacts 202 at a predetermined pitch.

The main body 302 includes an upper wall 330 above the contact channels 320 in the upper row and a lower wall 332 below the contact channels 320 in the lower row. The upper wall 330 is configured to support the contacts 202 in the contact channels 320. The lower wall 332 is configured to support the contacts 202 in the contact channels 320. The upper wall 330 defines portions of the contact channels 320 in the upper row and the lower wall 332 defines portions of the contact channels 320 in the lower row. In an exemplary embodiment, the contact channels 320 are entirely surrounded by the insert 300. For example the contact channels 320 in the upper row are surrounded by the base wall 324, the two corresponding separating walls 322 and the upper wall 330. The contact channels 320 and the lower row are surrounded by the base wall 324, the two corresponding separating walls 322 and the lower wall 332.

In an exemplary embodiment, the insert 300 includes a pocket 334 at the front. The pocket 334 is configured to receive the circuit card 120. In an exemplary embodiment, the front wall 304 is stamped to define the pocket 334. For example, the upper wall 330 and the lower wall 332 extend forward of the base wall 324 such that the front wall 304 is stepped into the pocket 334. The upper wall 330 defines an upper platform 336 above the pocket 334 and the lower wall 332 defines a lower platform 338 below the pocket 334. Portions of the contact channels 320 may extend along the upper platform 336 and the lower platform 338.

In an exemplary embodiment, the insert 300 includes tabs 340 extending into the contact channels 320, such as at the front ends of the contact channels 320. The upper row of contact channels 320 have the tabs 340 extending from the upper wall 330 and the lower row of contact channels 320 have the tabs 340 extending from the lower wall 332. The tabs 340 include cam surfaces 342, such as at the rear edges of the tabs 340. The cam surfaces 342 are configured to engage the contacts 202 to drive the contacts 202 inward for mating with the circuit card 120. For example, when the insert 300 is moved rearward to the retracted position, the cam surfaces 342 may engage the contacts 202 to drive the contacts 202 inward toward the circuit card 120. The cam surfaces 342 that engage the ground contacts may be defined by the mating interfaces 362 (shown in FIG. 5). The cam surfaces 342 may be curved, such as to prevent damaging the contacts 202.

The ground bus bars 350 are coupled to the insert 300 at the upper wall 330 and the lower wall 332. In an exemplary embodiment, the ground bus bars 350 are located at the tabs 340. The grounding fingers 360 may be located at the cam surfaces 342 for engaging the ground contacts 352.

FIG. 9 is a partial sectional view of a portion of the communication system 100 showing the insert 300 in the cavity 150 of the housing 110 in the forward position. FIG. 10 is a partial sectional view of a portion of the receptacle connector 104 showing the insert 300 in the cavity 150 of the housing 110 in the retracted position. The circuit card 120 is shown in FIG. 9 partially loaded into the slot 116 but is not electrically connected to the contacts assembly 200. The circuit card 120 is removed in FIG. 10 to illustrate the contact assembly 200 and the insert 300.

In the forward position, the separating walls 322 are positioned between the tips 226. The dielectric material of the separating walls 322 fills the contact gaps 232 between the contacts 202 in the upper row 204 and in the lower row 206. For example, the separating walls 322 may partially fill the contact gaps 232 or the separating walls 322 may entirely filled the contact gaps 232. The dielectric material of the base wall 324 fills a contact space 234 between the contacts 202 in the upper row 204 and the contacts 202 in the lower row 206. However, when the insert 300 is moved to the retracted position (FIG. 10), the insert 300 is moved rearward away from the tips 226. For example, the separating walls 322 may be moved rearward along the mating beams 224 and the tips 226 may be free of the dielectric material of the insert 300 therebetween. The tips 226 may be more exposed to air when the insert 300 is moved to the retracted position, which affects the electrical performance of the contacts 202 at the mating interfaces 230. For example, by reducing the amount of plastic material in the mating zone, the impedance may be increased. The high dielectric constant of the dielectric material of the insert 300 may be replaced by air, having a lower dielectric constant than the plastic material, thus raising the impedance in the mating zone by eliminating or removing the plastic material of the insert 300 from between or around the tips 226 of the contacts 202 in the mating zone.

In an exemplary embodiment, the receptacle connector 104 has a forward air gap 370 in the insert chamber 152 forward of the insert 300 and a rear air gap 372 in the insert chamber 152 rearward of the insert 300. The forward air gap 370 is defined as being located between the front wall 304 and a front wall 162 of the cavity 150. The rear air gap 372 is defined as being located between the rear wall 306 and the front wall 212 of the holder 210. The insert 300 is movable within the insert chamber 152 to change the size, shape and/or volume of the forward air gap 370 and the rear air gap 372. For example, when the insert 300 is in the forward position, the forward air gap 370 may be relatively small and the rear air gap 372 may be relatively large. However, when the insert 300 is in the retracted position (FIG. 10), the forward air gap 370 may be relatively large and the rear air gap 372 may be relatively small. By increasing the volume of air in the forward air gap 370 surrounding the tips 226 of the contacts 202 at the mating zone, the impedance of the contacts 202 may be affected. By decreasing the volume of air in the rear air gap 372, and increasing the amount of plastic material surrounding the mating beams 224 in the retracted position, the impedance of the contacts 202 along the mating beams 224 may be decreased. Optionally, the size and shape of the insert 300 may be selected to control the impedance in the mating zone along the tips 226 and along the mating beams 224 for impedance matching along the length of the contacts 202. For example, the impedance along the tips 226 and along the mating beams 224 may be closer than conventional receptacle connectors that provide plastic material along the entire lengths of the contacts 202, such as along the mating beams 224 and along the tips 226. By moving the insert 300 rearward, the amount of plastic material in the mating zone along the tips 226 may be reduced to increase the impedance of the contacts 202 along the tips 226.

In the retracted position, the insert 300 is pushed rearward toward and/or against the holder 210. In an exemplary embodiment, during loading of the circuit card 120 into the housing 110, the card edge 126 abuts against the front wall 304 of the insert 300. Loading of the circuit card 120 further into the slot 116 forces the insert 300 to move rearward to the retracted position. The circuit card 120 is used to push the insert 300 from the forward position (FIG. 9) to the retracted position (FIG. 10). The mating ends 222 of the contacts 202 are configured to engage the circuit card 120 in the retracted position. The insert 300 is used to push the contacts inward toward the circuit card 120 to engage the upper and lower surfaces of the circuit card 120.

When the insert 300 is in the retracted position, the contacts 202 extend forward of the insert 300. The cam surfaces 342 are pushed rearward into the contacts 202 to drive the contacts 202 inward. For example, the cam surfaces 342 engage the ramps 228 to drive the contacts 202 inward (the upper contacts are driven downward and the lower contacts are driven upward toward the card 120). The cam surfaces 342 ride along the tips 226 to the ramps 228 and when engaging the ramps 228, the contacts 202 are moved inward. In the retracted position, the tips 226 extend forward of the insert 300. The contact gaps 232 between the tips 226, such as at the mating interfaces 230, are filled with air, rather than the plastic material of the insert 300.

Figure 11:
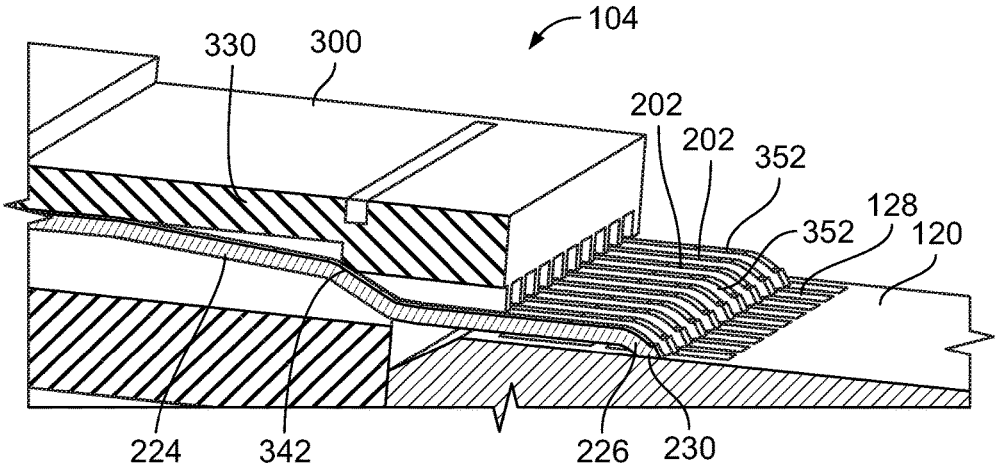
FIG. 11 is a partial sectional view of a portion of the receptacle connector showing the insert in the retracted position.
Figure 12:
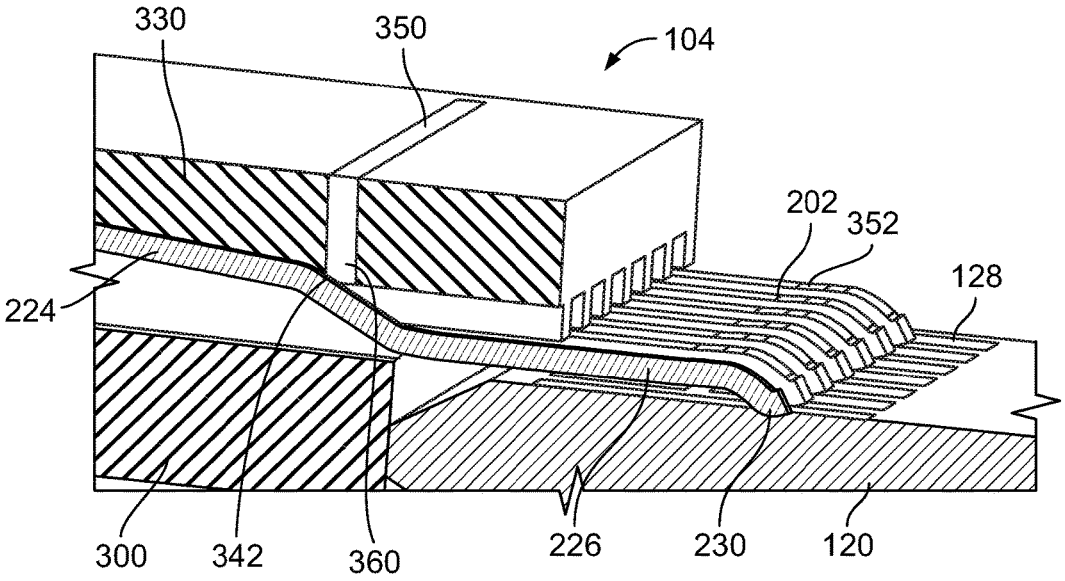
FIG. 12 is a partial sectional view of a portion of the receptacle connector showing the insert in the retracted position.

FIG. 11 is a partial sectional view of a portion of the receptacle connector 104 showing the insert 300 in the retracted position showing a signal contact 202 in the forefront. FIG. 12 is a partial sectional view of a portion of the receptacle connector 104 showing the insert 300 in the retracted position showing a ground contact 352 in the forefront. The cam surfaces 342 are shown engaging the contacts 202, 352. The cam surfaces 342 force the mating beams 224 and the tips 226 pushed away from the upper wall 330. The tips 226 are pushed into engagement with the circuit card 120. The mating interfaces 230 are pressed against the contact pads 128. The tips 226 are spring biased against the contact pads 128.

In an exemplary embodiment, the ground bus bar 350 engages the ground contact 352. For example, the ground finger 360 is provided along the cam surface 342 to engage the ground contact 352. The ground bus bar 350 is electrically connected to the ground contact 352.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector system comprising:

a receptacle connector having a housing, a contact assembly held in the housing and an insert movably received in the housing and supporting the contact assembly;

the housing having a cavity, the housing having a mating end including a slot open to the cavity, the slot being configured to receive a circuit card;

the contact assembly received in the cavity, the contact assembly including contacts arranged in an upper row and a lower row, each contact having a base fixed in the cavity and a mating end movable relative to the base between an undeflected position and a deflected position, each contact having an inner surface and an outer surface opposite the inner surface, the inner surfaces of the contacts in the upper row facing the inner surfaces of the contacts in the lower row across the cavity, the inner surfaces defining mating interfaces at the mating ends configured to engage the circuit card;

the insert being received in the cavity and being movable in the cavity between a forward position and a retracted position, the insert holding the mating ends of the contacts in the undeflected positions when in the forward position, the insert engaging the outer surfaces of the contacts and forcing the contacts inward to the deflected positions when in the retracted position.

2. The electrical connector system of claim 1, wherein the contacts include ground contacts and signal contacts, and wherein the insert comprises a ground bus bar engaging corresponding ground contacts to electrically common the corresponding ground contacts when the insert is in the retracted position.

3. The electrical connector system of claim 1, wherein the insert includes cam surfaces, the cam surfaces being spaced apart from the contacts when the insert is in the forward position, the cam surfaces engaging the contacts and driving the contacts inward to engage the circuit card when the insert is in the retracted position.

4. The electrical connector system of claim 1, wherein the contact assembly includes a holder holding the bases of the contacts, the contacts extending from the holder in the upper row and the lower row, the mating ends of the contacts in the upper row being spaced apart from the mating ends of the contacts in the lower row by a first distance when the insert is in the forward position, the mating ends of the contacts in the upper row being spaced apart from the contacts in the lower row by a second distance less than the first distance when the insert is in the retracted position.

5. The electrical connector system of claim 4, wherein the first distance is greater than a height of the slot, and wherein the second distance is less than the height of the slot.

6. The electrical connector system of claim 1, further comprising a return spring held in the housing being operably coupled to the insert, the return spring biasing the insert forward toward the forward position.

7. The electrical connector system of claim 1, wherein the insert includes a front wall facing the slot, the front wall being configured to engage the circuit card when the circuit card is received in the slot to push the insert rearward to the retracted position.

8. The electrical connector system of claim 1, wherein the insert includes contact channels separated by separating walls, each contact channel receiving a corresponding contact, the mating ends of the contacts being positioned in the contact channels between the separating walls when the insert is in the forward position, the separating walls being moved rearward of the mating ends of the contacts when the insert is moved to the retracted position.

9. The electrical connector system of claim 1, wherein a portion of the insert is forward of the mating ends of the contacts in the forward position and wherein the entire insert is rearward of the mating ends of the contacts in the retracted position.

10. The electrical connector system of claim 1, wherein the insert presses the contacts inward toward the circuit card in the retracted position to engage the circuit card.

11. The electrical connector system of claim 1, wherein the contacts comprise upper contacts in the upper row and lower contacts in the lower row, the insert including a main body having upper contact channels and lower contact channels, the upper contact channels being defined by an upper wall having an upper cam surface, the lower contact channels being defined by a lower wall having a lower cam surface, the upper cam surface engaging the upper contacts as the insert is moved to the retracted position, the upper cam surface driving the upper contacts downward into the circuit card, the lower cam surface engaging the lower contacts as the insert is moved to the retracted position, the lower cam surface driving the lower contacts upward into the circuit card.

12. The electrical connector system of claim 1, further comprising a forward air gap forward of the insert and a rear air gap rearward of the insert, a volume of the forward air gap increasing as the insert is moved from the forward position to the retracted position.

13. An electrical connector system comprising:

a receptacle connector having a housing, a contact assembly held in the housing and an insert movably received in the housing and supporting the contact assembly;

the housing having a cavity, the housing having a mating end including a slot open to the cavity, the slot being configured to receive a circuit card;

the contact assembly received in the cavity, the contact assembly including signal contacts and ground contacts arranged in both an upper row and a lower row, each signal contact having a signal beam extending to a mating end, each ground contact having a ground beam extending to a mating end;

the insert being received in the cavity and being movable in the cavity between a forward position and a retracted position, the insert having a ground bus bar, the insert engaging the signal contacts and the ground contacts and forcing the signal contacts and the ground contacts into mating engagement with the circuit card when the insert is in the retracted position, the ground bus bar engaging the ground beams to electrically connect corresponding ground contacts when in the retracted position.

14. The electrical connector system of claim 13, wherein the insert includes cam surfaces, the cam surfaces being spaced apart from the signal contacts when the insert is in the forward position, the cam surfaces engaging the signal contacts and driving the signal contacts inward to engage the circuit card when the insert is in the retracted position.

15. The electrical connector system of claim 13, wherein the contact assembly includes a holder holding bases of the signals contacts, the signal contacts extending from the holder in the upper row and the lower row, the mating ends of the signal contacts in the upper row being spaced apart from the mating ends of the signal contacts in the lower row by a first distance when the insert is in the forward position, the mating ends of the signal contacts in the upper row being spaced apart from the signal contacts in the lower row by a second distance less than the first distance when the insert is in the retracted position.

16. The electrical connector system of claim 13, further comprising a return spring held in the housing being operably coupled to the insert, the return spring biasing the insert forward toward the forward position.

17. The electrical connector system of claim 13, wherein the insert includes contact channels separated by separating walls, each contact channel receiving a corresponding signal contact, the mating ends of the signal contacts being positioned in the contact channels between the separating walls when the insert is in the forward position, the separating walls being moved rearward of the mating ends of the signal contacts when the insert is moved to the retracted position.

18. The electrical connector system of claim 13, wherein a portion of the insert is forward of the mating ends of the signal contacts in the forward position and wherein the entire insert is rearward of the mating ends of the signal contacts in the retracted position.

19. An electrical connector system comprising:

a receptacle connector having a housing, a contact assembly held in the housing and an insert movably received in the housing and supporting the contact assembly;

the housing having a cavity, the housing having a mating end including a slot open to the cavity, the slot being configured to receive a circuit card;

the contact assembly received in the cavity, the contact assembly including signal contacts and ground contacts arranged in both an upper row and a lower row, each signal contact having a signal beam extending to a mating end, each ground contact having a ground beam extending to a mating end, each signal beam having an inner surface and an outer surface opposite the inner surface, each ground beam having an inner surface and an outer surface opposite the inner surface, the inner surfaces defining mating interfaces configured to engage the circuit card;

the insert being received in the cavity and being movable in the cavity between a forward position and a retracted position, the insert engaging the outer surfaces of the signal beams and forcing the mating ends of the signal contacts into mating engagement with the circuit card when the insert is in the retracted position, the insert engaging the outer surfaces of the ground beams and forcing the mating ends of the ground contacts into mating engagement with the circuit card when the insert is in the retracted position, the mating ends being positioned closer to each other in the retracted position compared to the forward position for mating the contacts with the circuit card, the mating ends being more exposed to air when the insert is in the retracted position.

20. The electrical connector system of claim 19, wherein the insert comprises a ground bus bar engaging the ground contacts to electrically common the corresponding ground contacts when the insert is in the retracted position.

* * * * *